US006138325A

United States Patent [19]

Figliola et al.

[11] Patent Number: 6,138,325

[45] Date of Patent: Oct. 31, 2000

[54] MOUNTING DEVICE FOR A WINDOW HINGE

[75] Inventors: Umberto Figliola, Wellington; Michael Gerrard Francis, Upper Hutt, both of New Zealand

[73] Assignee: Interlock Group Limited, New Zealand

[21] Appl. No.: 09/112,397

[22] Filed: Jul. 8, 1998

[30] Foreign Application Priority Data

Jul. 8, 1997 [NZ] New Zealand ..... 328283

[51] Int. Cl.[7] ..... E05D 5/00; E05D 15/00

[52] U.S. Cl. ..... 16/382; 16/363; 16/368; 16/366; 49/246

[58] Field of Search ..... 16/382, 383, 363, 16/365, 366, 368; 49/453, 457, 246, 248, 345, 339

[56] References Cited

U.S. PATENT DOCUMENTS

| | | | |
|---|---|---|---|
| 3,796,072 | 3/1974 | Weeks | 70/89 |
| 3,867,790 | 2/1975 | Frank | 49/381 |
| 4,259,811 | 4/1981 | Davis | 49/356 |
| 4,756,122 | 7/1988 | Snapka | 49/57 |
| 4,982,476 | 1/1991 | Salice | 16/382 |
| 5,210,908 | 5/1993 | Bucher | 16/368 |
| 5,450,654 | 9/1995 | Sullivan | 16/370 |

*Primary Examiner*—Anthony Knight
*Assistant Examiner*—Robert L. Pilaud
*Attorney, Agent, or Firm*—Blakely Sokoloff Taylor & Zafman

[57] ABSTRACT

A mounting arrangement for a window stay. The mounting arrangement comprises a mounting bracket 11 which is mountable to a part of a window construction such as a window frame or window sash. The mounting bracket 11 has an abutment 25 with an opening 26 to receive a tab 27 at one end of the mounting base 10 of the window stay. The mounting bracket 11 also has a clip 23 which can engage with a cut-out 28 in the mounting base 10 of the window stay. The window stay can thus be quickly located with a mounting base already mounted to a window construction.

19 Claims, 4 Drawing Sheets

MOUNTING DEVICE FOR A WINDOW HINGE

BACKGROUND OF THE INVENTION

1. Discussion of the Background

The present invention concerns improvements in window stays and more particularly an arrangement for the quick detachment and mounting of window stays with the frame of a window.

2. Description of the Related Art

The term window stay is commonly used to describe a hinge which, when used in pairs, enables a window sash to be adjustably mounted in a window frame. The window stay generally includes a frame mounting element which enables the stay to be mounted to the window frame and a sash mounting element which enables the sash to be mounted to the window stay. These mounting elements are fixedly attached to the frame and sash by use of mechanical fasteners engaged through openings in the mounting elements and into a part of the frame and sash as the case may be.

In some house constructions windows are located in poured concrete walls such as, for example, the basement of the house. Very often the basement walls are an extension of the poured concrete foundation. The window frame in such situations is required to be set into the concrete. To achieve the setting of the frames into the poured concrete the window sash is typically removed from the frame, the frame then being mounted in a "buck" which is essentially two flat sheets, one either side of the frame pulled together by a mechanical fastener, e.g., a nut and bolt arrangement. The buck is positioned in the form work and the concrete is poured around the frame. When the concrete is set the buck is removed and the sash is then installed in the frame.

This process is time-consuming and can lead to a poor fit of the sash within the frame.

SUMMARY OF THE INVENTION

The object of the present invention is to provide a mounting arrangement whereby a window stay can be readily removed from the window frame and subsequently reinstalled.

Broadly in one aspect the present invention provides a mounting arrangement for a window stay, said mounting arrangement comprising a mounting bracket adapted for attachment to a part of a window construction, the mounting bracket having engagement means for detachably engaging with a part of a window stay.

DESCRIPTION OF THE PREFERRED EMBODIMENTS

Figure 1:
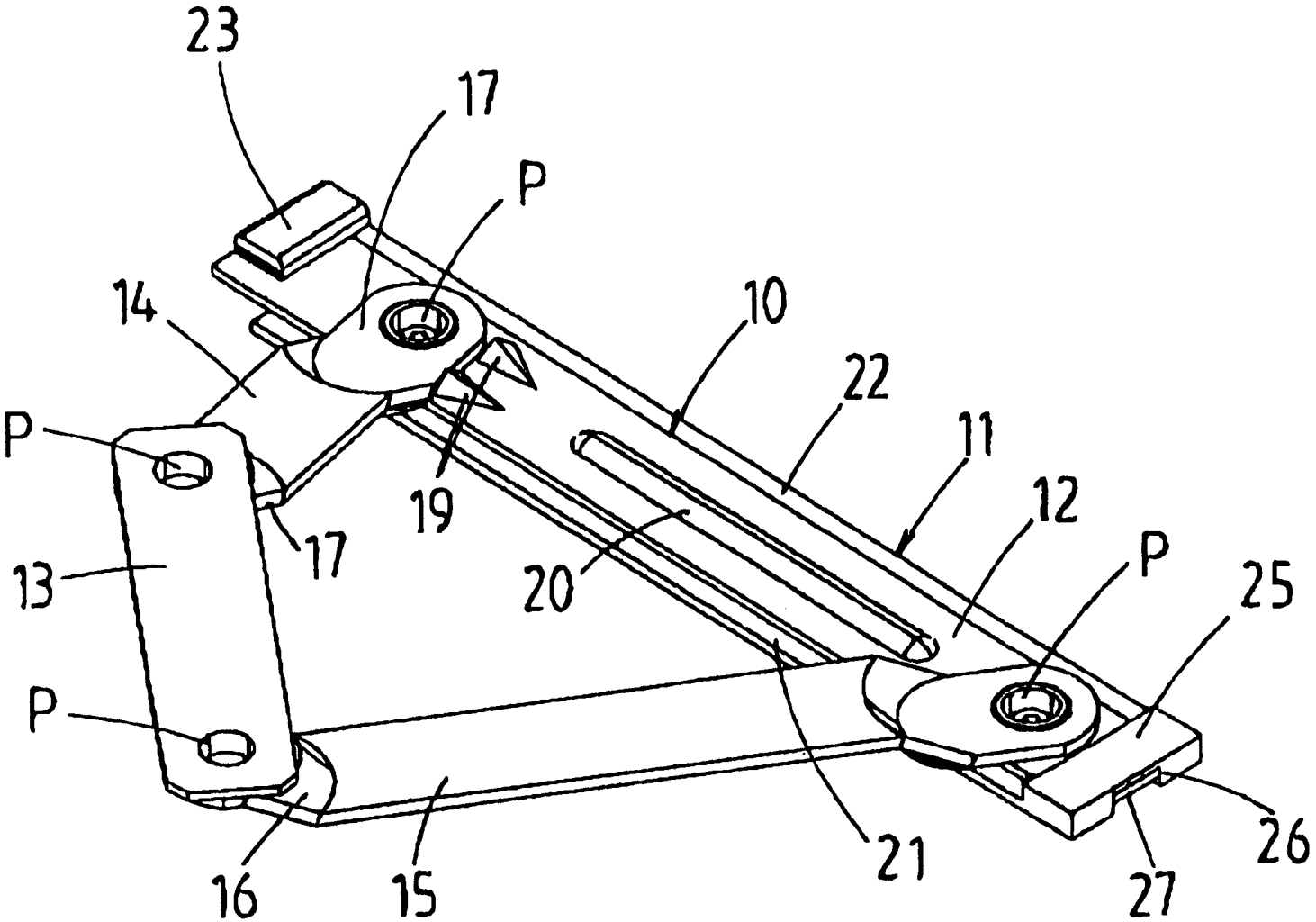
FIG. 1 is a perspective view of a window stay and mounting bracket in a mounting arrangement according to the present invention.
Figure 2:
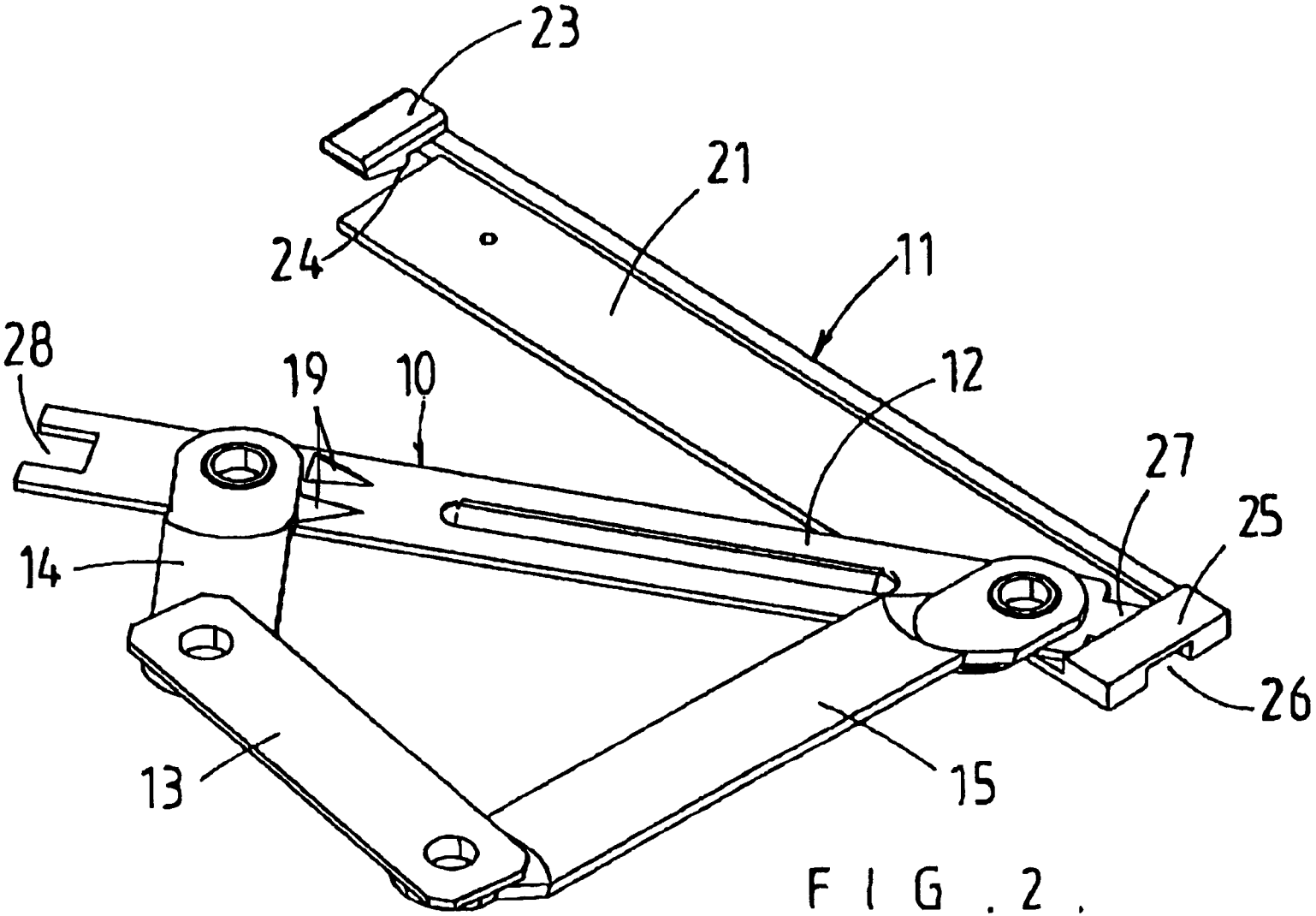
FIG. 2 is a perspective view showing the window stay in the process of being installed with the mounting bracket.

The mounting arrangement according to the present invention can be used with a window stay having a mounting element preferably in the form of a single mounting plate. In the following description and as shown in FIGS. 1 and 2 the window stay 10 can be a so-called four bar stay. The mounting arrangement is formed by a combination of the frame plate of the window stay 10 and a mounting bracket 11.

The window stay 10, as shown by way of illustration in the accompanying drawings, has a frame mounting plate 12 and a sash mounting plate 13 which are pivotally coupled together via short arm 14 and long arm 15 in a typical four bar window stay arrangement. The cranked ends 16 of long arm 15 and cranked ends 17 of short arm 14 are respectively coupled to the frame and mounting plates via pivots P. These pivots P can be of a so-called no friction, low friction or friction type in accordance with known window stay pivot technology. In the preferred form the pivots P are hollow centered so as to be able to receive therethrough mechanical fasteners to facilitate fixing of the stay to the frame and sash as, for example, described in New Zealand patent specification 202214.

In a preferred form of the window stay 10, the mounting plates 12 and 13 and arms 14 and 15 can be manufactured from stainless steel. Also, according to a preferred form of the invention, one or more stops 19 are pressed out of the frame mounting plate 12 which stop the rotation of the short arm 14 when the stay has reached the fully open position. Furthermore, in a preferred form of the invention, one or more longitudinal ribs 20 can be pressed out of the frame plate 12 for strengthening purposes.

Figure 3:
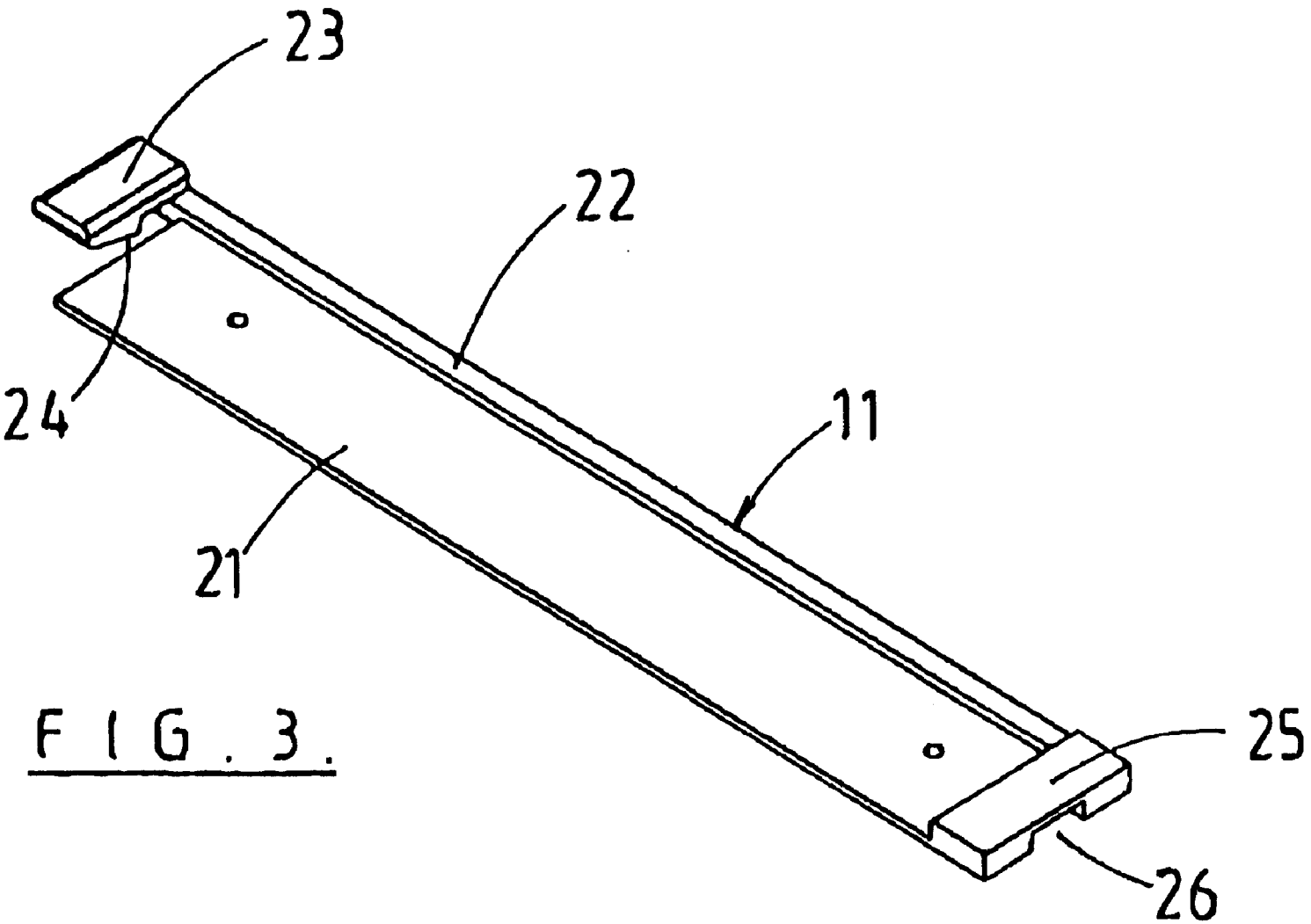
FIG. 3 is a perspective view of the mounting bracket.
Figure 4:
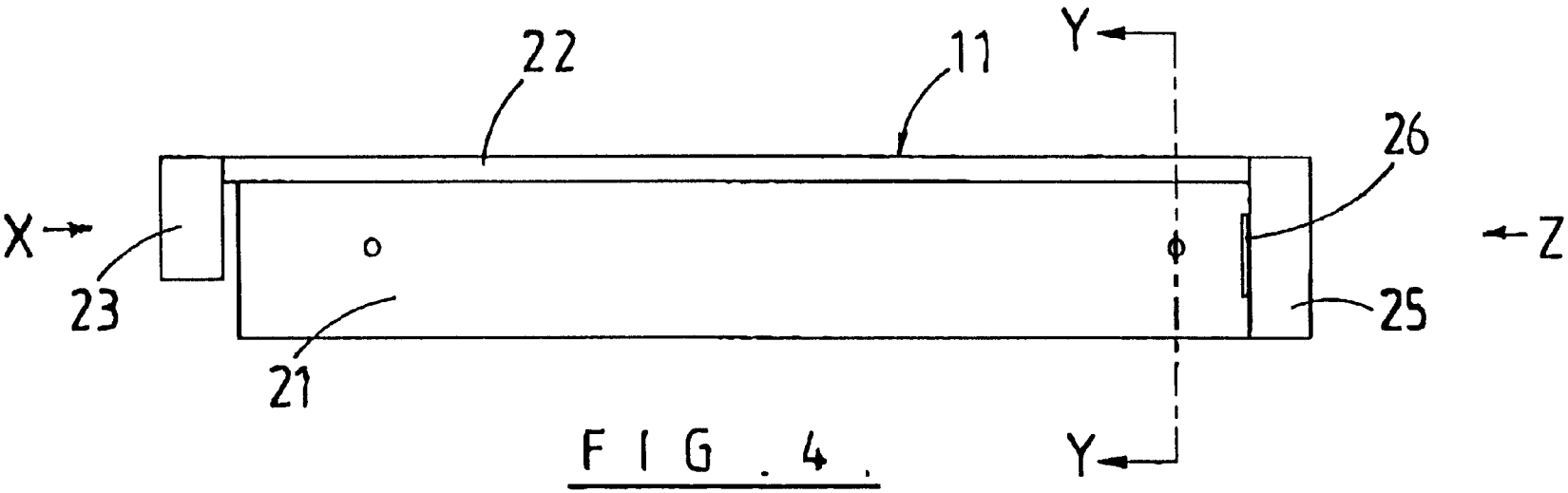
FIG. 4 is a plan view of the mounting bracket.
Figure 5:
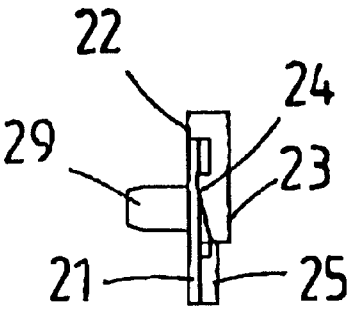
FIG. 5 is an end view in the direction of Arrow X of the mounting bracket.

The mounting bracket 11 can be formed from any suitable material though in the preferred form of the invention it is manufactured by moulding from a suitable plastics material. The mounting bracket 11 has a mounting surface 21 along one long edge of which is an abutment or rib 22. This abutment or rib 22 projects beyond one end of the mounting surface 21 and carries a clip 23. The underside of the clip 23 has a ramp portion 24, the purpose of which will hereinafter become apparent. This ramp 24 terminates a distance from the abutment or rib 22 as can be seen in FIGS. 3 and 5.

At the opposite end of the mounting bracket 11 there is provided an abutment 25 which has an opening or slot 26.

As can be seen in FIG. 2 the frame mounting plate 12 has a tab 27 at the end to which the long arm 15 is pivotally coupled. A cut-out 28 is formed at the end of the mounting plate 12 to which the short arm 14 is pivotally coupled. In the preferred form of the invention for manufacturing purposes the configuration of the tab 27 corresponds to the profile of the cut-out 28 so that successive mounting plates 12 can be stamped from metal strip without any undue wastage.

As can be seen in FIG. 2 the window stay 10 is installed on the mounting bracket 11 by aligning the tab 27 with slot or opening 26 with the frame mounting plate 12 being located at an angle to the mounting surface 21. The frame mounting plate 12 is then pivoted toward the bracket 11 so that tab 27 slips further into opening 26. The stay becomes fully installed in the position shown in FIG. 1 when the ramp 24 slides over the leading edge of th e mounting plate 12 to finally engage in cut-out 28.

The interaction of tab 27 fully located in slot or opening 26 and the snap lock effect of ramp 24 fitting into cut-out 28 firmly holds the mounting plate 12 on the mounting bracket 11. However, the clip 23 can be prized upwardly to provide a clearance between the ramp 24 and cut-out 28 so that the stay can be removed in a reverse procedure.

Figure 7:
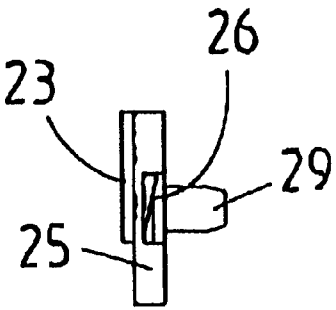
FIG. 7 is an end view of the mounting bracket taken in the direction of Arrow Z.
Figure 6:
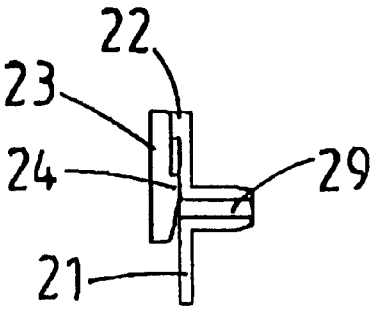
FIG. 6 is a section of the mounting bracket on line Y—Y.

As shown in FIGS. 5, 6 and 7, the underside of the mounting surface 21 of the moulded mounting bracket 11 has a pair of hollow spigots 29. These are provided to enable location of the mounting bracket in position on the window frame. In the preferred form of the invention the hollow pivots P of the mounting frame 12 align with the bores of the respective spigots 29.

The outer peripheral surface of the spigots 29 may have one or a series of circumferential protrusions or barbs to provide positive retention in the window frame or such. Also, the spigots may be slotted to allow them to collapse on installation and to allow them to expand when fasteners (fixing screws) are driven into place.

In use of the invention the moulded in mounting plate 11 is accurately fitted to the frame of the window at the time of manufacture. The window stay 10 is then installed in the mounting bracket in the manner previously described. The clip 23 is of sufficient strength to retain the stay during transportation of the window frame to a building site.

Once on site, clip 23 is released enabling the sash to be removed. This permits the frame to be set in place in the concrete or basement wall. When the time comes to refit the sash the stays 10 are easily located in the mounting bracket 11 and clipped into place. Permanent fixings can then be inserted and generally these will in the arrangement illustrated be through the hollow centres of pivots P coupling the arms 14 and 15 to the frame mounting plate 12. However, it will be appreciated that separate openings can be formed in the mounting plate 12 for receiving the fasteners.

The top surface of the clip 23 can be so orientated above the surface of the frame mounting plate 12 to fit snugly under the short arm 14 when the stay is in the closed position. In a casement arrangement the short arm 14 is thus supported so as to spread the load carried by the arm through to the frame mounting plate 12. Clip 23 could also in such an arrangement act as a riser block to cause the short arm 14 of the lower stay to rise into the required position to close the sash correctly into the frame.

The mounting arrangement according to the present invention thus allows a stay to be accurately positioned by a window manufacturer whilst enabling a builder or end user to easily remove the sash for the installation of the frame and to subsequently reinstall the sash accurately and securely.

It will be appreciated that while the present invention is primarily intended for use when a window frame is to be set into a poured concrete wall the use of the mounting arrangement is not restricted solely to such an end use. Furthermore, it will be appreciated by those skilled in the art that the mounting arrangement according to the present invention is not limited to use with a four bar window stay of the type illustrated.

What is claimed is:

1. In combination a window stay which includes a mounting component and a stay mounting device wherein the stay mounting device is mountable to a part of a window frame, said stay mounting device including a locating means and spaced therefrom an attachment means, said mounting component of the stay including a first engagement portion for removable location with said locating means and a second engagement portion for detachable engagement with said attachment means following the mounting component becoming located by the locating means.

2. The combination of claim 1 wherein the locating means is an aperture and the first engagement portion is a tab which locates in said aperture, the attachment means is an arm with an abutment and the second engagement portion is an opening into which said abutment locates.

3. The combination of claim 1 or 2 wherein there is further included a longitudinally extending location member positioned to abut with the stay mounting component when the mounting component is located on the stay mounting device.

4. The combination of claim 1 wherein the window stay is a four bar stay.

5. The combination of claim 1 wherein the stay mounting device includes at least one projection which extends from a side of the stay mounting device opposite to a side of the stay mounting device which engages the mounting component.

6. The combination of claim 5 wherein the projection includes a bore which aligns with a hollow pivot bearing of the window stay when the mounting component is located in position with the stay mounting device.

7. The combination of claim 6 wherein the attachment means is movable to release the mounting component.

8. A window construction including a pair of window stays adjustably mounting a sash in a window frame, a stay mounting component of each window stay being mounted to the sash or frame in a combination as claimed in claim 1.

9. The window construction as claimed in claim 8 wherein the projection includes a bore which aligns with a hollow pivot bearing of the window stay and a mechanical fastener is engaged through said hollow pivot bearing and into the projection which is located in an opening in said sash or frame.

10. The window construction as claimed in claim 9 wherein the projection includes retention means to enhance retention of the projection in the opening in said sash or frame.

11. A mounting arrangement as claimed in claim 10 wherein the projection is a hollow spigot and the retention means is at least one circumferential protrusion.

12. A mounting device in a window stay of the type which has a mounting plate for mounting the stay to a selected one of a part of a window frame and a sash, the mounting device including a base mountable to the frame or sash, as selected, a locating element on the base with which a first part of the mounting plate is removably locatable, an attachment device mounted with the base positioned a distance from the locating element, said attachment device detachably engageable with said mounting plate following the mounting plate becoming located by the locating element.

13. The mounting device as claimed in claim 12 wherein the base is substantially elongate, said locating element being positioned toward one end thereof and said attachment device the other end thereof.

14. The mounting arrangement as claimed in claim 13 wherein a location member extends longitudinally along at least part of the base.

15. The mounting arrangement as claimed in claim 14 wherein the location member extends along one side of the base between said locating element and said attachment device.

16. The mounting arrangement as claimed in claim 15 wherein the locating element includes an aperture.

17. The mounting arrangement as claimed in claim 16 wherein the attachment device is an arm having at its distal end an abutment means.

18. The mounting arrangement as claimed in claim 15 wherein the base, locating element, location member and attachment device are formed integrally in one piece from a plastics material, the locating element including an aperture in an upstand and the attachment device is an arm having at its distal end a ramped abutment.

19. A window stay which includes a mounting component in combination with the mounting arrangement as claimed in claim 18.

* * * * *